US006996852B1

(12) United States Patent
Cabrera

(10) Patent No.: US 6,996,852 B1
(45) Date of Patent: Feb. 14, 2006

(54) HEAD COVERING

(76) Inventor: Juan C. Cabrera, 9025 S. Napa Ave., San Joaguin, CA (US) 93660

( * ) Notice: Subject to any disclaimer, the term of this patent is extended or adjusted under 35 U.S.C. 154(b) by 265 days.

(21) Appl. No.: 10/642,556

(22) Filed: Aug. 18, 2003

(51) Int. Cl.
*A42B 1/06* (2006.01)

(52) U.S. Cl. ..... 2/172; 2/171; 2/209.13; 2/175.1; 2/207

(58) Field of Classification Search ..... 248/466; 160/323, 324, 264, 237; 2/171.03, 175.6, 2/202, 207, 206, 410, 175.4, 209.11, 195.3, 2/195.2, 209.13, 209.14, 184.5
See application file for complete search history.

(56) References Cited

U.S. PATENT DOCUMENTS

| | | | | | |
|---|---|---|---|---|---|
| 213,415 | A * | 3/1879 | Halvorson | ..... | 2/171.03 |
| 5,125,113 | A * | 6/1992 | Yun | ..... | 2/10 |
| 5,669,075 | A * | 9/1997 | Weeks | ..... | 2/172 |
| 5,815,841 | A * | 10/1998 | Spangrud | ..... | 2/195.1 |
| 5,884,337 | A * | 3/1999 | Dudley, Jr. | ..... | 2/209.14 |
| 5,924,129 | A * | 7/1999 | Gill | ..... | 2/10 |
| 6,446,266 | B1 * | 9/2002 | Park | ..... | 2/195.1 |

* cited by examiner

*Primary Examiner*—John J. Calvert
*Assistant Examiner*—Richale L. Haney

(57) ABSTRACT

A head covering for shielding the head neck, face and ears from the harsh elements of the environment with obstructing the user's vision. The head covering includes a cap including a head cover member and a bill; and also includes a shroud assembly including a shroud being removably depending from the cap; and further includes fastening members for fastening the shroud to the cap; and also includes a mirror assembly including a mirror being hingedly attached to the bill for allowing a user to view about oneself while wearing the head covering.

9 Claims, 4 Drawing Sheets

HEAD COVERING

BACKGROUND OF THE INVENTION

1. Field of the Invention

The present invention relates to head coverings and more particularly pertains to a new head covering for shielding the head neck, face and ears from the harsh elements of the environment with obstructing the user's vision.

2. Description of the Prior Art

The use of head coverings is known in the prior art. More specifically, head coverings heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 899,334; U.S. Pat. No. 5,448,778; U.S. Pat. No. 5,081,717; U.S. Pat. No. Des. 401,393; U.S. Pat. No. Des. 363,812; and U.S. Pat. No. Des. 380,591.

While these devices fulfill their respective, particular objectives and requirements, the aforementioned patents do not disclose a new head covering. The prior art includes caps and capes being draped from the caps.

SUMMARY OF THE INVENTION

The general purpose of the present invention, which will be described subsequently in greater detail, is to provide a new head covering which has many of the advantages of the head coverings mentioned heretofore and many novel features that result in a new head covering which is not anticipated, rendered obvious, suggested, or even implied by any of the prior art head coverings, either alone or in any combination thereof. The present invention includes a cap including a head cover member and a bill; and also includes a shroud assembly including a shroud being removably depending from the cap; and further includes fastening members for fastening the shroud to the cap; and also includes a mirror assembly including a mirror being hingedly attached to the bill for allowing a user to view about oneself while wearing the head covering. None of the prior art includes the combination of the elements of the present invention.

There has thus been outlined, rather broadly, the more important features of the head covering in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new head covering which has many of the advantages of the head coverings mentioned heretofore and many novel features that result in a new head covering which is not anticipated, rendered obvious, suggested, or even implied by any of the prior art head coverings, either alone or in any combination thereof.

Still another object of the present invention is to provide a new head covering for shielding the head neck, face and ears from the harsh elements of the environment without obstructing the user's vision.

Still yet another object of the present invention is to provide a new head covering that is easy and convenient to set up and use.

Even still another object of the present invention is to provide a new head covering that prevents dust and other particles from coming into contact with the user's head, and also prevents the user's head from becoming sunburned.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
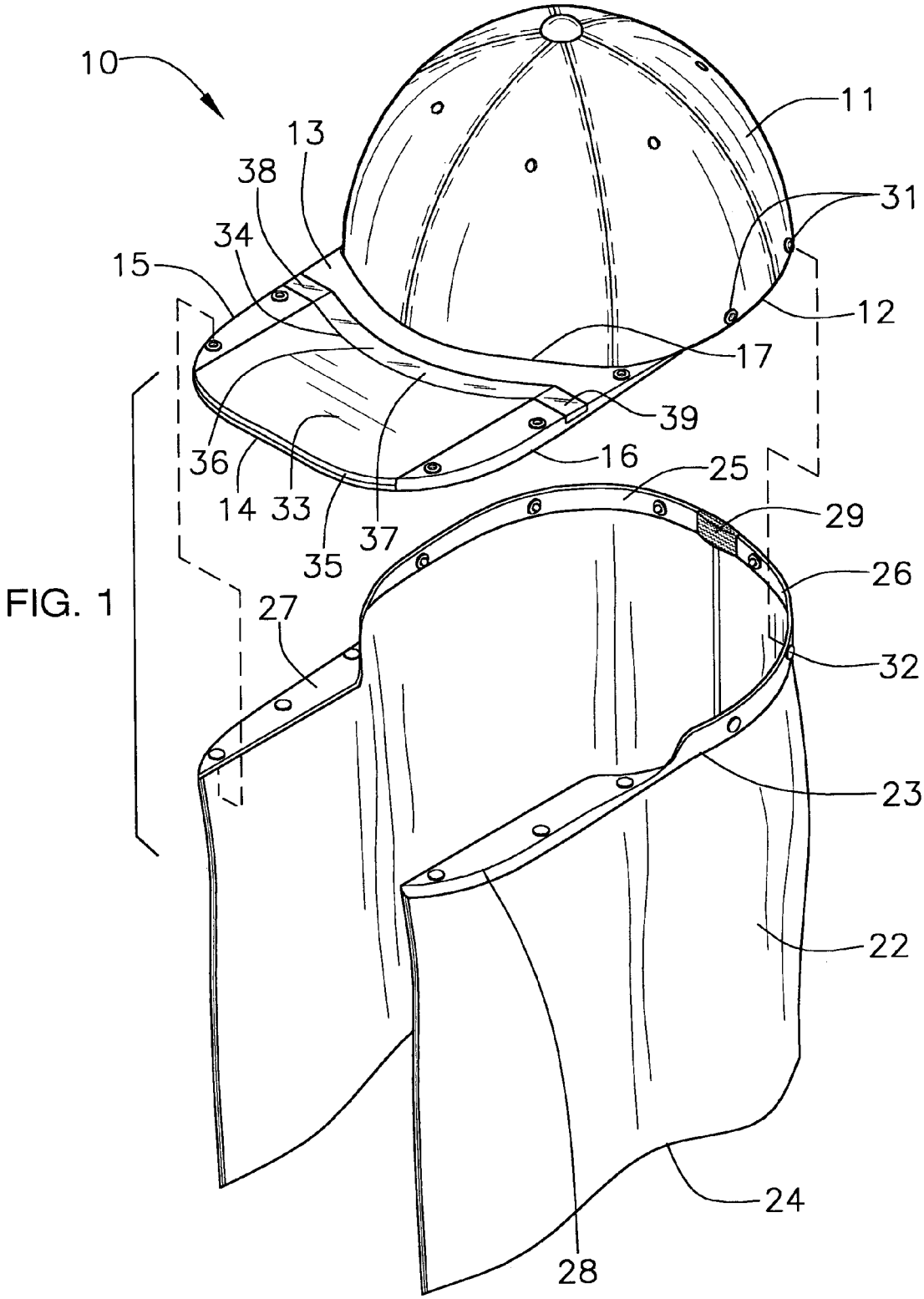
FIG. 1 is an exploded perspective view of a new head covering according to the present invention.
Figure 2:
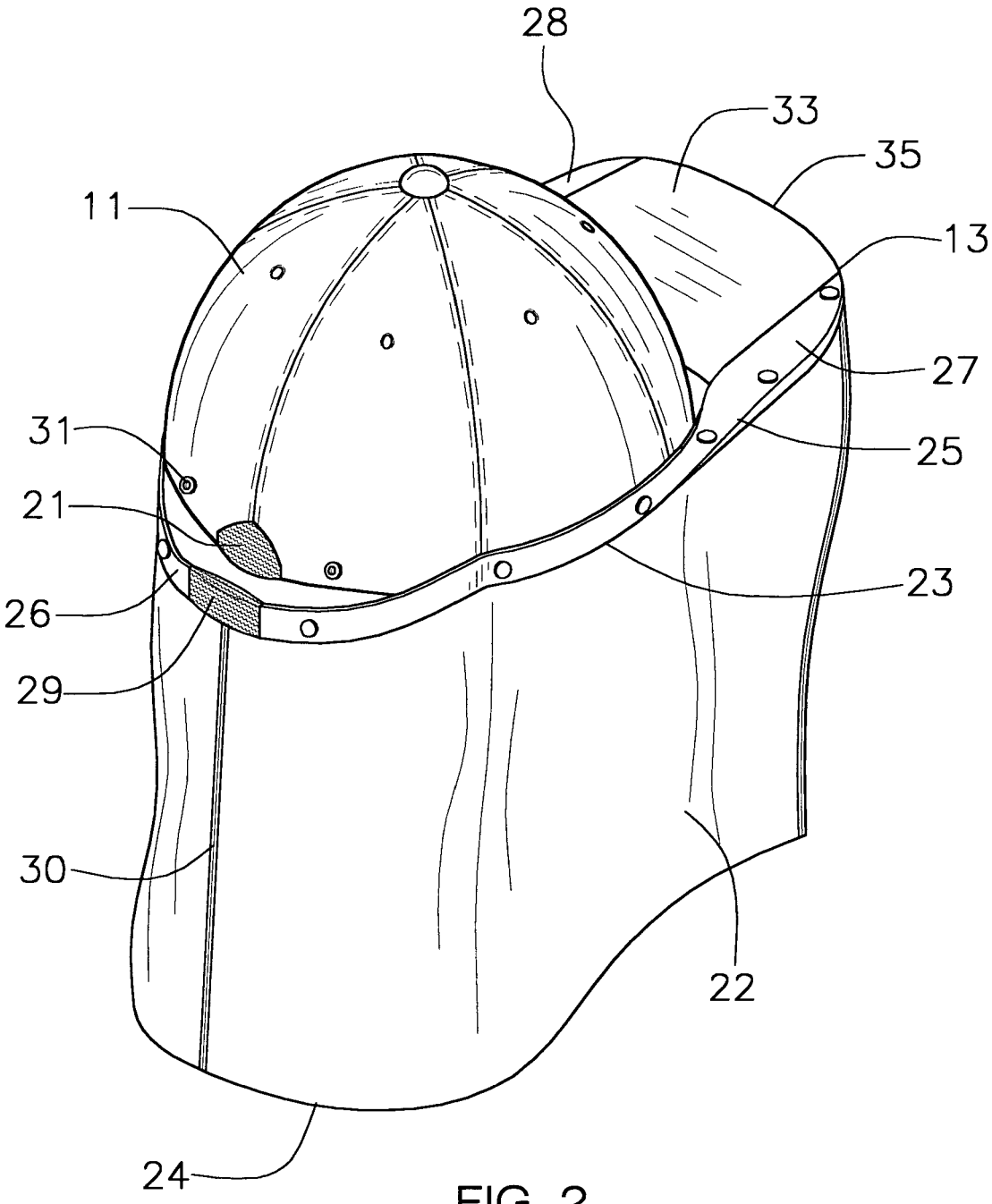
FIG. 2 is a perspective view of the present invention.
Figure 3:
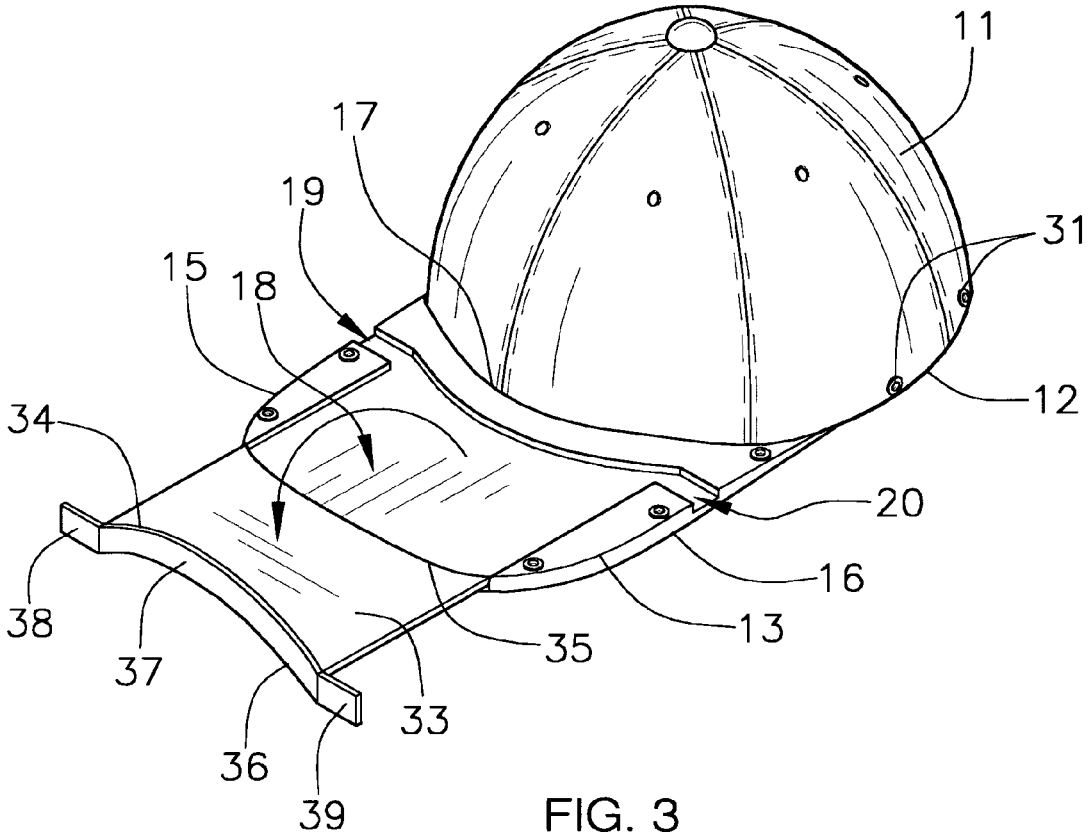
FIG. 3 is a perspective view of the cap and mirror of the present invention.
Figure 4:
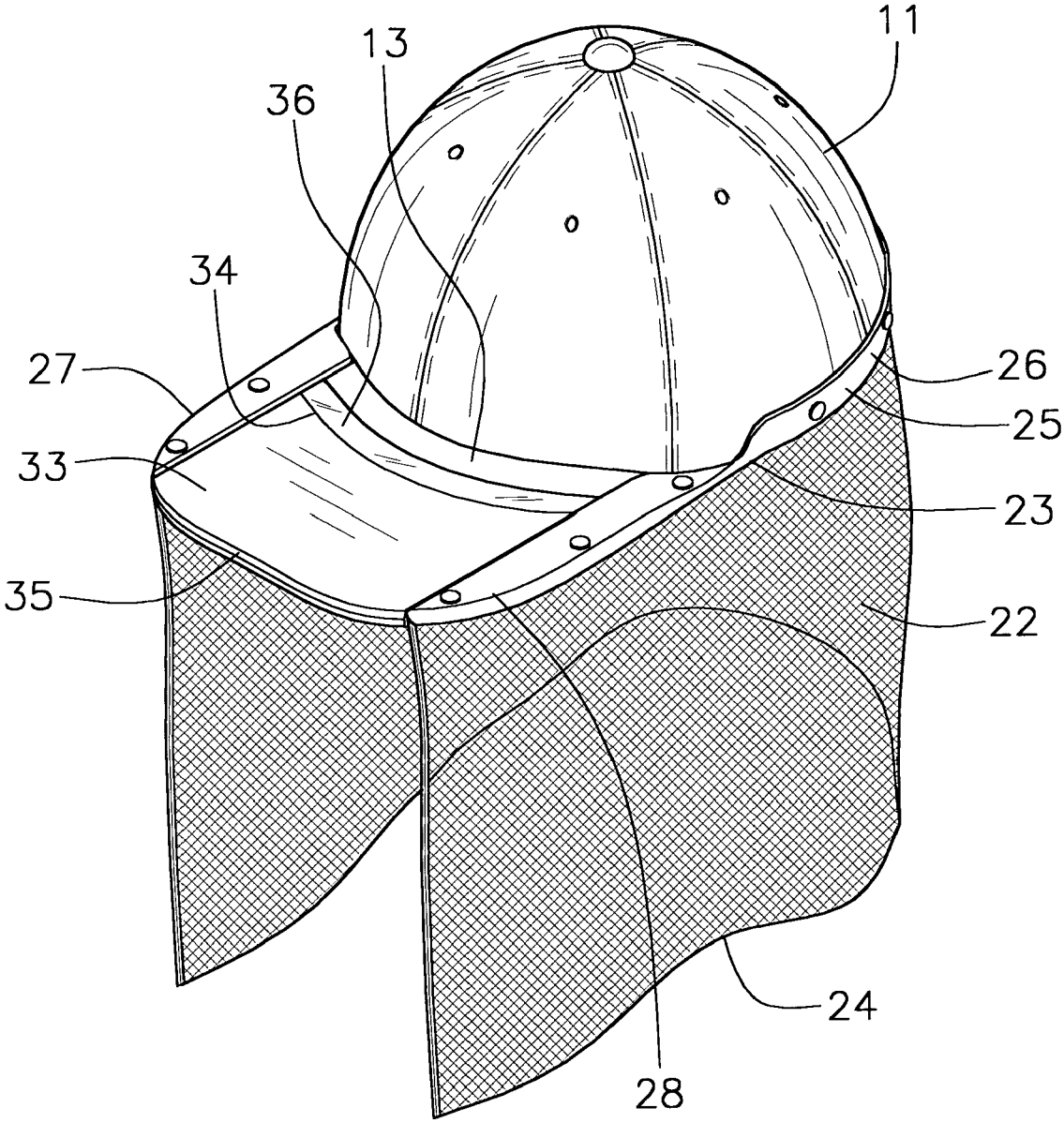
FIG. 4 is a perspective view of a second embodiment of the present invention.

With reference now to the drawings, and in particular to FIGS. 1 through 4 thereof, a new head covering embodying the principles and concepts of the present invention and generally designated by the reference numeral 10 will be described.

As best illustrated in FIGS. 1 through 4, the head covering 10 generally comprises a cap including a head cover member 11 and a bill 13. The bill 13 is securely attached and sewn to the head cover member 11, and extends forwardly therefrom, and has a top side, and further has a recessed portion 18-20 being disposed in the top side. The recessed portion 18-20 includes a mirror-receiving recessed portion 18 extending through a portion of a front edge 14 of the bill 13 and being spaced from side edges 15,16 of the bill 13 and extending along and being spaced from a portion of a back edge 17 of the bill 11, and also includes handle-receiving recessed portions 19,20 being disposed through the side edges 15,16 of the bill 11 and being continuous offshoots of the mirror-receiving recessed portion 18. The cap 11,13 further includes a first elastic tab 21 being conventionally attached to a back side and to a bottom edge 12 of the head cover member 11 for adjusting the size of the head cover member 11.

A shroud assembly includes a shroud 22 being removably depending from the cap 11,13. The shroud assembly also includes a support strip 25 being conventionally attached along a top edge 23 of the shroud 22, and further includes a second elastic tab 29 being conventionally attached to the support strip 25 for adjusting the size of the support strip 25, and also includes a stiffener strip 30 being conventionally disposed in an intermediate portion of the shroud 22 and extending from the top edge 23 to a bottom edge 24 of the shroud 22 so that the shroud will drape directly below the cap 11,13 and be blown about in the wind. The support strip 25 includes a head cover attaching portion 26, and also includes bill attaching end portions 27,28. The head cover attaching portion 26 and the bill attaching end portions 27,28 are planar portions with the planar portion of the head cover attaching portion 26 being disposed generally 90 degrees relative to the planar portions of the bill attaching end portions 27,28 to facilitate attaching the support strip 25 to the head cover member 11 and to the bill 13. The shroud 22 is a sheet of material being removably depending from the bottom edge 12 of the head cover member 11 and from the side edges 15,16 of the bill 13.

Fastening members 31,32 for fastening the shroud to the cap 11,13 include first fastening members 31 being conventionally attached along the bottom edge 12 of the head cover member 11 and along the side edges 15,16 of a bottom side of the bill 13, and also include second fastening members 32 being conventionally attached along the support strip 25 and being fastenable to the first fastening members 31.

A mirror assembly includes a mirror 33 being conventionally attached to the bill 13 for allowing a user to view about oneself while wearing the head covering 10. The mirror 33 has a back edge 35 which is conventionally attached to the front edge 14 of the bill 13 and also has a front edge 34. The mirror 33 folds upon and off the bill 13 and is removably received in the mirror-receiving recessed portion 18. The mirror assembly further includes an elongate handle member 36 being conventionally attached to the front edge 34 of the mirror 33. The elongate handle member 36 has a main portion 37 being removably received in the mirror-receiving recessed portion 18 and also having end portions 38,39 being removably received in the handle-receiving recessed portions 19,20.

As a second embodiment, the shroud 22 is a sheet of mesh material being removably depending from the bottom edge 12 of the head cover member 11 and from the side edges 15,16 of the bill 13.

In use, the user fastens the shroud 22 to the cap 11,13 and places the head cover member 11 about one's head with the shroud 22 being draped over the back and sides of the user's head. To effectively see about oneself, the user can remove the mirror 33 from the mirror-receiving recessed portion 18 to extend the mirror forwardly of the bill 13. The user can look up into the mirror 33 to effectively see about the draped shroud 22.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the head covering. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A head covering comprising:

a cap including a head cover member and a bill, said bill being securely attached to said head cover member, and extending forwardly therefrom, and has a top side, and further having a recessed portion disposed in said top side, said recessed portion including a mirror-receiving recessed portion extending through a portion of a front edge of said bill and being spaced from side edges of said bill and extending along and being spaced from a portion of a back edge of said bill, and also including handle-receiving recessed portions being disposed through said side edges of said bill and being continuous offshoots of said mirror-receiving recessed portion;

a shroud assembly including a shroud being removably depending from said cap;

fastening members for fastening said shroud to said cap; and a mirror assembly including a mirror being attached to said bill for allowing a user to view about oneself while wearing said head covering.

2. The head covering as described in claim 1, wherein said cap further includes a first elastic tab being attached to a back side and to a bottom edge of said head cover member for adjusting the size of said head cover member.

3. The head covering as described in claim 2, wherein said mirror has a back edge which is attached to said front edge of said bill and also has a front edge, said mirror being foldable upon and off said bill and being removably received in said mirror-receiving recessed portion.

4. The head covering as described in claim 3, wherein said mirror assembly further includes an elongate handle member being attached to said front edge of said mirror, said handle member having a main portion being removably received in said mirror-receiving recessed portion and also having end portions being removably received in said handle-receiving recessed portions.

5. The head covering as described in claim 4, wherein said shroud assembly also includes a support strip being attached along a top edge of said shroud, and further includes a second elastic tab being attached to said support strip for adjusting the size of said support strip, and also includes a stiffener strip being disposed in an intermediate portion of said shroud and extending from said top edge to a bottom edge of said shroud for preventing said shroud from being blown about in the wind.

6. The head covering as described in claim 5, wherein said support strip includes a head cover attaching portion, and also includes bill attaching end portions, said head cover attaching portion and said bill attaching end portions being planar portions, said planar portion of said head cover attaching portion being disposed generally 90 degrees relative to said planar portions of said bill attaching end portions to facilitate attaching said support strip to said head cover member and to said bill.

7. The head covering as described in claim 6, wherein said fastening members include first fastening members being attached along said bottom edge of said head cover member and along said side edges of a bottom side of said bill, and also include second fastening members being attached along said support strip and being fastenable to said first fastening members.

8. The head covering as described in claim 7, wherein said shroud is a sheet of material being removably depending from said bottom edge of said head cover member and from said side edges of said bill.

9. The head covering as described in claim 8, wherein said shroud is a sheet of mesh material being removably depending from said bottom edge of said head cover member and from said side edges of said bill.

* * * * *